US006641187B2

(12) United States Patent
Hsu

(10) Patent No.: US 6,641,187 B2
(45) Date of Patent: Nov. 4, 2003

(54) SELF-CLOSING BAG HOLDER AND ASSEMBLY

(76) Inventor: Yungtai Hsu, 10725 E. Rush St., South El Monte, CA (US) 91733

( * ) Notice: Subject to any disclaimer, the term of this patent is extended or adjusted under 35 U.S.C. 154(b) by 0 days.

(21) Appl. No.: 10/076,973

(22) Filed: Feb. 15, 2002

(65) Prior Publication Data

US 2003/0155783 A1 Aug. 21, 2003

(51) Int. Cl.[7] ..... B65D 33/00
(52) U.S. Cl. ..... 294/1.1; 248/99; 383/33
(58) Field of Search ..... 294/1.1, 1.3, 1.4, 294/1.5, 31.2, 33, 55; 248/95, 99, 100; 15/257.1, 257.6; 383/12, 13, 25–27, 33, 34, 34.1, 59, 60

(56) References Cited

U.S. PATENT DOCUMENTS

| | | | | |
|---|---|---|---|---|
| 1,468,709 A | | 9/1923 | Grandeur et al. | |
| 3,848,841 A | | 11/1974 | Rafeldt | |
| 4,069,994 A | | 1/1978 | Wharmby | |
| 4,815,866 A | | 3/1989 | Martone | |
| 4,875,729 A | * | 10/1989 | Peck | 294/1.3 |
| 4,900,077 A | | 2/1990 | Beck | |
| 5,139,219 A | * | 8/1992 | Navarro | 248/97 |
| 5,167,390 A | * | 12/1992 | Baghdadi | 248/99 |
| 5,183,227 A | | 2/1993 | Wilhite | |
| 5,409,279 A | | 4/1995 | Magee | |
| 6,471,267 B2 | * | 10/2002 | Asazuma | 294/1.5 |

* cited by examiner

*Primary Examiner*—Dean J. Kramer
(74) *Attorney, Agent, or Firm*—Philip K. Yu; Birch Stewart LLP

(57) ABSTRACT

A self-closing bag holder for a flexible bag. The bag holder has a pair of resilient arms for supporting the bag and a pair of resilient handles. Each arm is joined with a handle by a rocker, which provides a fixed angle between the arm and the handle. The other ends of the arms are releasably hinged together. The other ends of the handles are joined together such that they bow away from each other because of the fixed angle rockers. The rockers are pivotally joined together, such that upon compressing the handles, the rockers will pivot to cause the arms to expand and bow away from each other, thus opening the flexible bag. Upon release of the handles, the arms will retract toward each other, thus closing the bag, while the handle will regain its originally bowed shape. The self-closing feature of the bag holder allows an operator to open and close the bag without having to touch the bag itself Also, when no pressure is exerted on the handles, the arms and thus the bag will remain closed.

21 Claims, 6 Drawing Sheets

SELF-CLOSING BAG HOLDER AND ASSEMBLY

FIELD OF THE INVENTION

The present invention relates generally to apparatus for supporting flexible bags so that they can be expanded to receive articles or refuse, and more particularly to a self-closing holder and assembly for flexible bags.

ART BACKGROUND

Flexible bags, such as those made of plastic material, have been in widespread use for collecting a variety of articles, including wastepaper, food scraps, trash and other disposable items which are commonly found in the kitchens, bathrooms, nurseries, workshops and offices. A typical plastic bag generally requires both hands of a user to handle the bag while collecting the articles, since the plastic bag cannot stand by itself with its mouth open. While it may be inconvenient, requiring both hands to handle the bag during collection will not be as undesirable if the items are not unsanitary.

In some scenarios, having to handle the flexible bag with even one hand poses a health risk, if the hand is now forced to make contact with unsanitary articles. For example, flight attendants on commercial airlines are often seen picking up dirty towels or trash from passengers in the cabin, using a plastic bag. While most flight attendants exercise great care, some will inadvertently touch the filthy articles with their hands, which are subsequently used to prepare food or drinks for the passengers. Even if the flight attendants use their hands only to hold the plastic bags open, for the passengers to toss in their trash, the flight attendants inevitably will have to tie the plastic bag up with their hands, using a plastic or metal tie strap. In a situation like this, the conventional flexible bag presents a serious health risk, since the flight attendants, and the passengers as well, can now be affected by the contact with the filthy articles.

Other than the airlines, healthcare professionals using flexible bags in medical clinics and hospitals are also vulnerable. While there are some self-closing trash cans already in use, such as those with a lid or push-door mechanism, someone will eventually have to tie up the bag when the bag has to be removed from the container for disposal. The situation is more dire for those trash cans without a lid, since the trash bag is now exposed.

SUMMARY OF THE INVENTION

It is an object of the present invention to provide an apparatus that opens and closes a flexible bag with single-hand operation, without the user having to touch the bag.

It is also an object of the present invention to provide an apparatus that closes the flexible bag without the user having to touch the bag.

It is yet another object of the present invention to provide an apparatus that closes the flexible bag and naturally maintains such closed position for eventual disposal.

It is further an object of the present invention to provide an apparatus that can be securely mounted to a rigid container or to the side of a furniture.

A self-closing bag holder for a flexible bag is disclosed. The bag holder is conveniently suitable for single-handed operation to open and close the bag holder and a flexible bag. The entire bag holder and bag assembly also allows convenient placement to the side of a furniture or to the wall. The bag holder has a pair of resilient arms for supporting the bag and a pair of resilient handles. Each arm is joined with a handle by a rocker, which provides a generally fixed angle between the arm and the handle. The other ends of the arms are releasably hinged together. The other ends of the handles are also joined together such that they naturally bow away from each other by virtue of the fixed-angle rockers. The rockers are pivotally joined together, such that upon compressing the handles, the rockers will pivot to cause the arms to expand and bow away from each other, thus opening the flexible bag. Upon release of the handles, the resilient arms will retract toward each other, thus closing the bag, while the handle will regain its originally bowed shape. The self-closing feature of the bag holder allows an operator to open and close the bag by squeezing the handles and without having to touch the bag itself Also, when no pressure is exerted on the handles, the arms, and thus the bag, will close and remain closed.

In another embodiment of the present invention, the resilient arms have locks implemented thereon to provide tight closure of the arms. The arms also have retaining hooks to prevent the bag from sliding back and forth on the arms.

In yet another embodiment of the present invention, the bag holder and bag assembly is mounted at the opening of a collection container. An operator squeezes the handles to open the arms and the bag for deposits, and releases the handles to close the bag. When the bag is full, the whole bag holder and bag assembly may be disposed of with ease.

Another embodiment of the present invention is directed to a bag holder and bag assembly, which can be mounted to the side of a piece of furniture, or to the wall.

DETAILED DESCRIPTION OF THE PREFERRED EMBODIMENT

A self-closing bag holder for flexible bags and combination are disclosed. The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices and mechanisms are omitted so as to not obscure the description of the present invention with unnecessary detail. Although the description makes reference to flexible bags and plastic bags, it should be apparent to those skilled in the art that the terms are used interchangeably. Therefore, they are used for illustrative, not limiting, purposes in the description.

Figure 1:
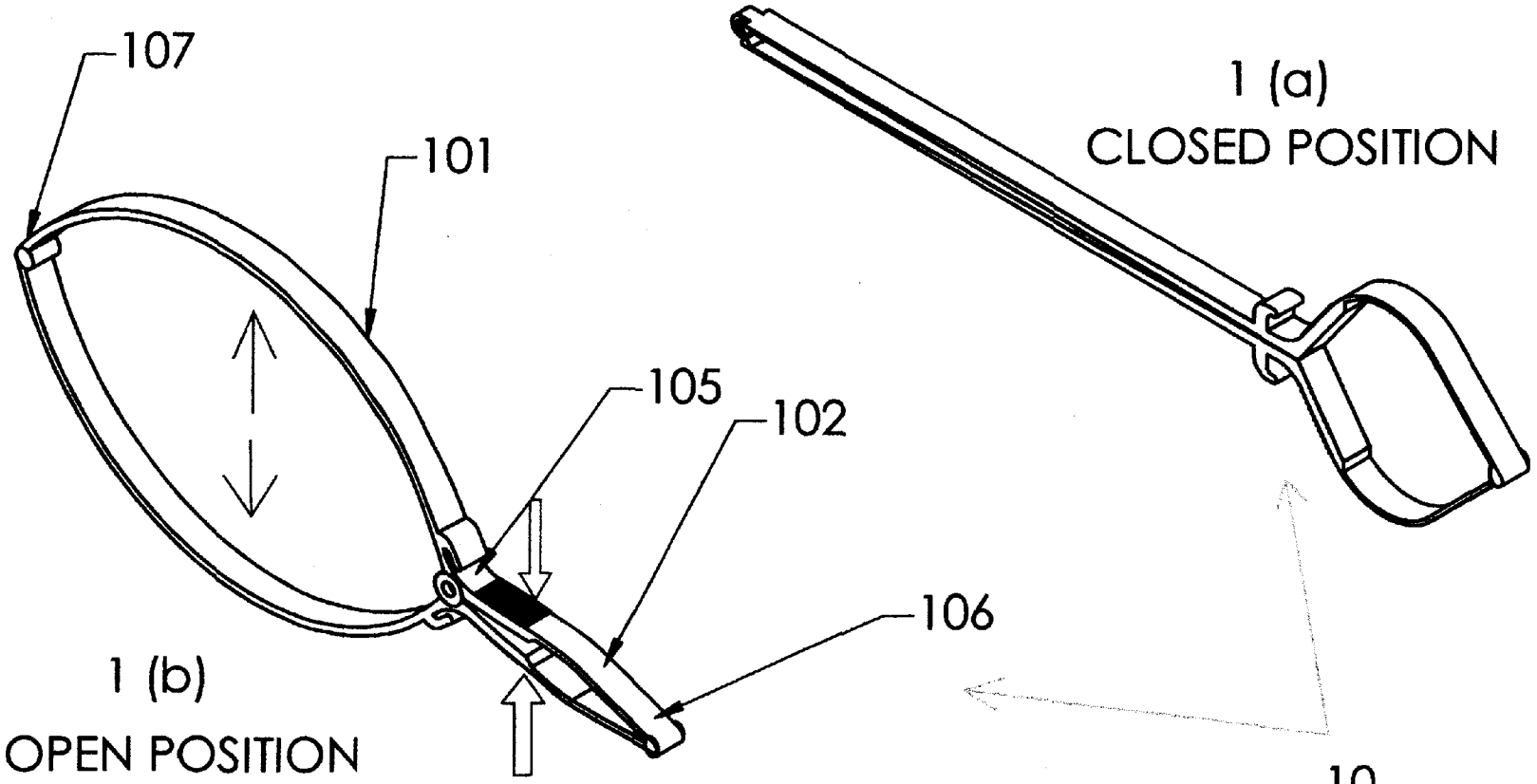
FIGS. 1(*a*) and (*b*) illustrate an exemplary self-closing bag holder in one embodiment of the present invention.

Reference is to FIGS. 1(*a*) and (*b*), where an exemplary self-closing bag holder in one embodiment of the present invention is shown. FIG. 1(*a*) shows bag holder 10 in a closed position, while FIG. 1(*b*) shows bag holder 10 in an opened position. Referring to FIGS. 1(*a*) and 1(*b*) generally, bag holder 10 has bag support arms 101 and handle arms 102. Bag support arms 101 and handle arms 102 are pairs of resilient members, which are preferably made of a flexible material, such as nylon, plastic or metal strips. Bag support arms 101 may also be tapered thereby diminishing in thickness from the rockers to the far end point. Currently, the support arms and handle arms are constructed so that they are capable of supporting up to 5 lbs of load. However, it should be apparent to those skilled in the art that the bag holder can readily be constructed for different load requirements or using different flexible material, provided that they follow mechanical and elasticity requirements.

A member of support arm 101 and a member of handle arm 102 are joined by rocker 105, which provides a substantially fixed angle between the members of support arm 101 and handle arm 102, as bag holder 10 is opened and closed. Both rockers 105 may be engaged by a hinge to allow rockers 105 to pivot, as handle arms 102 are compressed and support arms 101 are expanded. Alternatively, both rockers 105 may be joined by a thin connector, such as nylon, which is integrally formed along with the whole bag holder 10. It should be appreciated by those skilled in the art that the angle of rocker 105 is related to how wide the bag can be opened. The larger the angle, the larger the flexible support arms will open. Currently, the preferred angle is approximately between 150° and 185°.

Referring first to support arms 101, both members of support arms 101 are releasably engaged at the other end by hinge 107, which is formed by snapping the complementary ends of the support members together. By "complementary," it should be appreciated by those skilled in the art that the tip of one support arm 101 may have a pair of "ears" implemented (shown in FIG. 4, 440), while the tip of the other support arm 101 may have a "tab" implemented (shown in FIG. 4, 430). When both tips are snapped into place, hinge 107 is formed to allow end points of the members of support arms 101 to rotate about a common axis of hinge 107. This "snap-on" engagement feature allows a flexible bag (not shown) to be fitted along both members of support arms 101, if the flexible bag is constructed to have a sleeve around the bag's opening.

Referring now to handle arms 102, handle arms 102 are preferably a "closed" loop for a better grip. Both members of handle arms 102 may be joined together by coupler 106 at their ends, which may be a hinge, or a thin, e.g. a thickness of 0.1 mm, nylon connector integrally formed along with bag holder 10. Handle arm 102 is preferably shorter than support arm 101 such that given the fixed angle between support arms 101 and handle arms 102 dictated by rockers 105, both members of shorter handle arms 102 will tend to naturally bow outwardly away from each other, since they are relatively more flexible, in comparison to the longer members of support arms 101.

Those skilled in the art will appreciate that handle arms 102 may be made "open loop" without its members joining at the end to form a closed loop. In this case, handle arms 102 may need to be enlarged and padded to provide a better and comfortable grip for the users. However, a closed-loop of handle arms 102 provides better load bearing so that the stress on the hinge is reduced.

Figure 2:
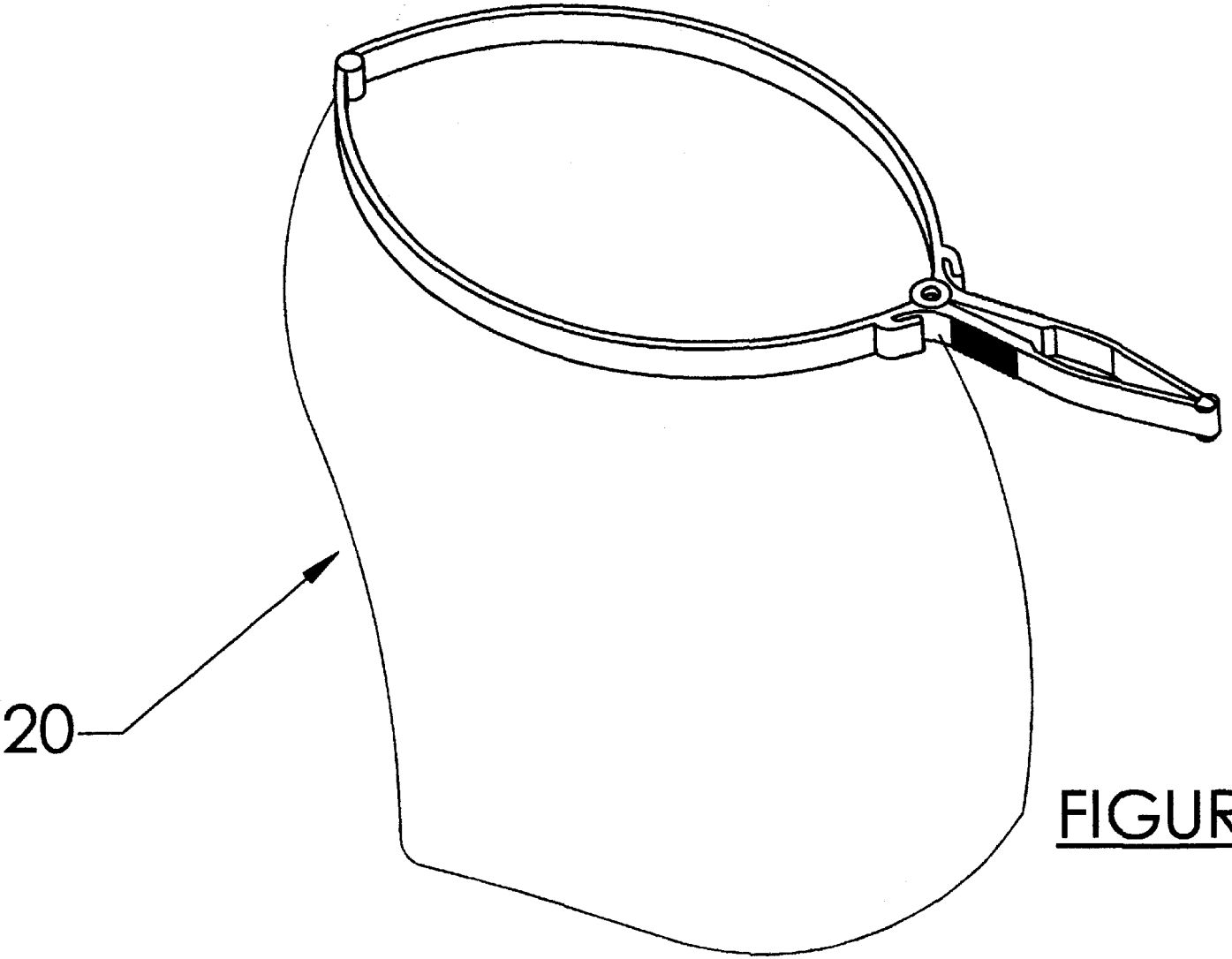
FIG. 2 illustrates an exemplary self-closing bag holder with a bag in an opened position.

The operation of bag holder 10 is now described with reference to FIG. 2. In operation, flexible bag 20 can be fitted through support arms 101 by opening and closing releasable hinge 107 of support arms 101. In a natural state, support arms 101 are closed and handle arms 102 are kept expanded, largely due the fixed angle provided by rockers 105. When trash is to be collected, the user presses and squeezes handle arms 102, thus causing rockers 105 to pivot around its axis to expand support arms 101, thereby opening flexible bag 20. Upon release of handle arms 102 by the user, the energy stored in the expanded support arms 101 forces its own closure and transfers energy back to handle arms 102, thus pivoting rockers 105. When bag 20 is full, the whole bag holder 10 and the bag 20 can be properly disposed of, all with bag 20 remaining closed. More importantly, the user never has to touch the bag to open and to close it. The bag is opened by the user's squeezing of handle arms 102. The bag will remain naturally closed when pressure is released on handle arms 102.

Flexible bag 20 can be constructed with a sleeve formed around its opening, which is commonly used by plastic bags with pull-up strings through the sleeve. Two slits on each side of the sleeve allows one of support arms 101 to pass through to form hinge 107 with the other arm. Those skilled in the art can of course implement their own bag attachment mechanisms based on the teaching of the present invention, such as a latch, clasp, fastener, Velcro, adhesive or simple elastic rubber band.

Figure 3:
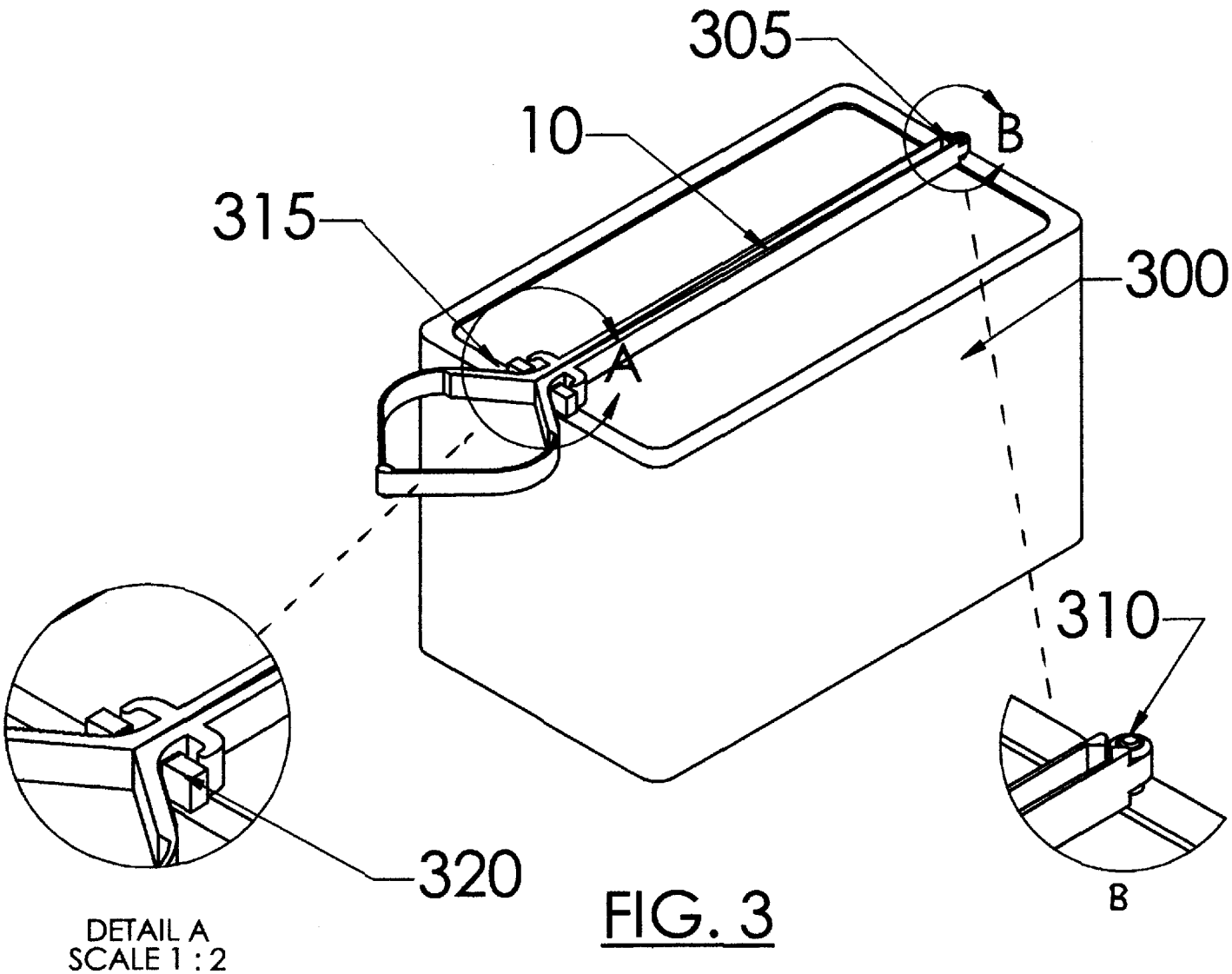
FIG. 3 illustrates a simplified diagram of an exemplary bag holder in another embodiment of the present invention.

The bag holder in accordance with the present invention can also be used in conjunction with a trash container. Reference is now to FIG. 3, where a simplified diagram of an exemplary bag holder in another embodiment of the present invention is illustrated. Bag holder 10 is placed on top of a container, such as a generally rectangular-shaped trash can 300. The shape of the container, of course, is not as material as the rim it has in order to support the bag holder. Container 300 may be mounted on a wall or be placed on the floor, depending upon the particular application. Container 300 and bag holder 10 are preferably engaged at two locations, at far-end 305 and mid-end 315 of bag holder 10. At far-end 305, a coupler on the rim, such as a male/female lock 310 can keep bag holder secured to container 300, without obstructing bag holder's movement for placement and removal. At mid-end 315, container 300 has a pair of protrusions or pegs 320, on its rim, to keep bag holder 10 also from horizontal movement.

In FIG. 3, far-end 305 is shown engaging to container 300 through the extended tip of one end of the support arm. It should be appreciated by those skilled in the art that other ways of engaging the bag holder to the container, such as those based on the principles of contact, elastic padding or friction, can be readily devised based on the teaching of the present invention.

When in use, bag holder 10 with a flexible bag can be placed on the rim of container 300 for collecting trash. When an article is to be disposed of, the user opens the support arms of bag holder 10 by compressing the handle arms. After the article is deposited into the bag, the support arms will naturally close after the handle arms are released by the user. When the bag is full, the whole assembly of bag holder 10 and bag, which remains closed, can be disposed of, and a new assembly replaced. The user does not have to touch the bag, thus avoiding the aforementioned health risks.

Figure 4:
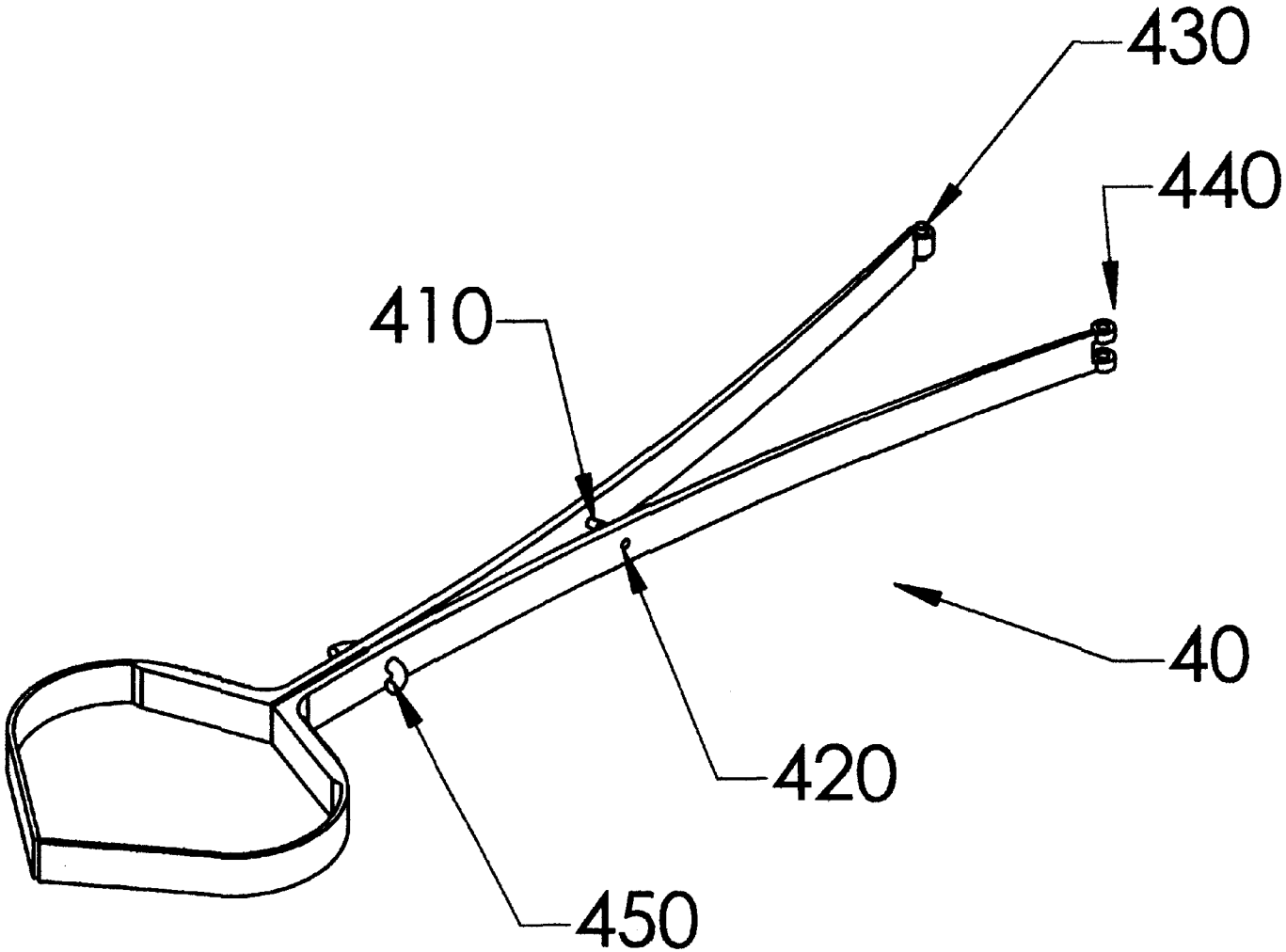
FIG. 4 illustrates an exemplary bag holder 40 in another embodiment of the present invention.
Figure 5:
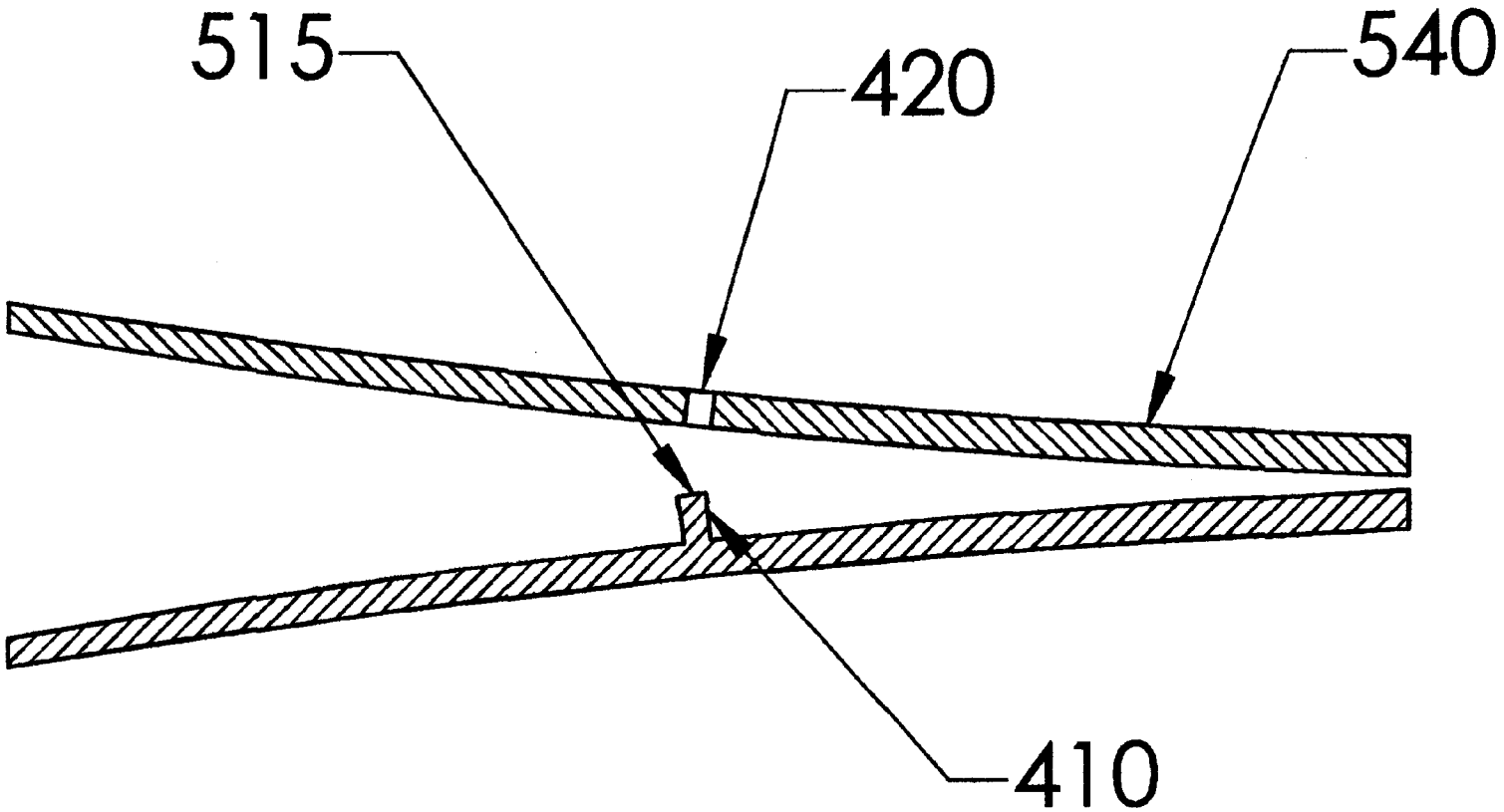
FIG. 5 illustrates an exemplary locking mechanism on the holder's arms.

FIG. 4 illustrates an exemplary bag holder 40 in another embodiment of the present invention. To ensure better closure of the bag, bag holder 40 in this embodiment is implemented with locks (410, 420) on the holder's arms. Here, on one arm of bag holder 40 is hole 420, while the other arm has a peg 410, which can be pressed and locked into hole 420 by virtue of its slightly larger rim of peg 410. A simplified diagram of peg 410 and hole 420 is illustrated in FIG. 5. Note that the end point 515 of peg 410 is sloped and slightly larger than the diameter of hole 420 such that easy entry and engagement can be achieved. Further, to provide better locking engagement, peg 410 enters hole 420 at a non-perpendicular angle, with respect to the surface 540 on which hole 420 is located. It should be appreciated by those skilled in the art that other forms of locking mechanism, e.g. by latch, clasp, fastener, or elastic band, are readily available to ensure the bag holder is secured closed.

Reference is still to FIG. 4. A hinge can be formed by snapping ears 440 and tab 430 from each support arm into place. To increase engagement, the top and bottom tips of tab 430 may also have an enlarged and sloped rim, similar to peg 410. Further, to achieve tighter closure of the support arms, the centers of tab 430 and ear 440 are preferably aligned with the length projection of each support arm 40, respectively. As such, when the arms of bag holder 40 are closed, the closure is made tighter. Additionally, to prevent the flexible bag from sliding back and forth on the support arms of bag holder 40, retaining locks 450 are implemented, which are of a hook-shape to engage the plastic bag. It should be pointed out that those skilled in the art can readily devise alternative modes of retaining lock, e.g. through a latch, an elastic band or an adhesive, to keep the rim of the bag adequately spread out throughout the support arms.

Figure 6:
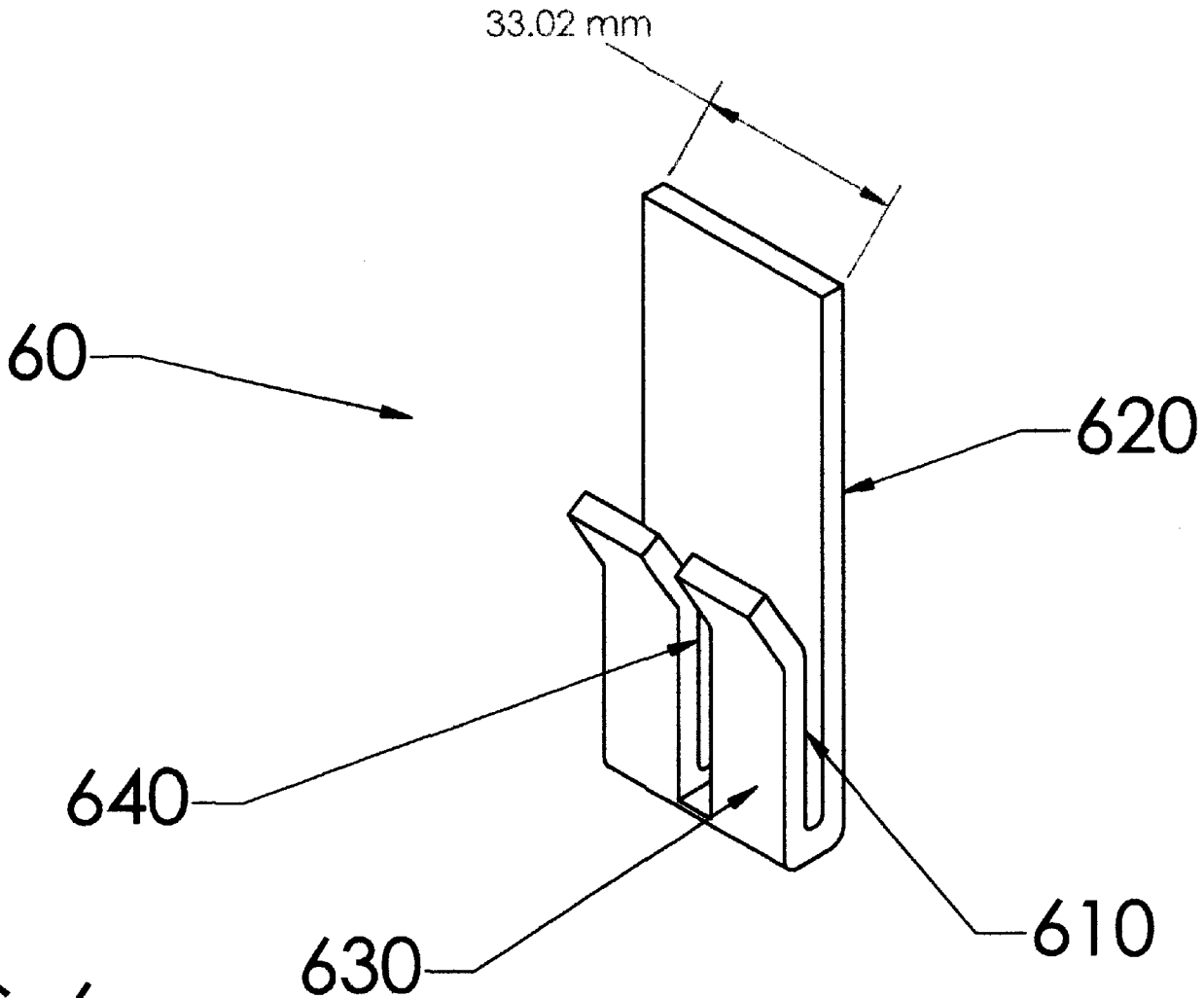
FIG. 6 illustrates an exemplary wall-mounted hook for the bag holder and bag assembly of the present invention.

The bag holder and bag assembly in accordance with the present invention may be supported by a pair of vertically-mounted hooks on the wall or on the side of a furniture, e.g. bedside stand. FIG. 6 illustrates an exemplary wall-mounted hook 60. Vertical plates 620, 630 and slot 610 formed in-between together support the arm of the bag holder. To provide better balance and. positioning of the arm of the bag holder, the spacing between vertical plates 620, 630 may be such that it is narrow at the top and a little wider at the bottom. Additionally, to provide better hold of the arm, vertical plates 620, 630 may be made of resilient material and be separated by a spacing that is narrower than the thickness of the arm. Notch 640 is for positioning peg 410 (FIGS. 4 and 5) and its width provides a secured position for the body of peg 410.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A self-closing bag holder, comprising:

a first resilient arm having a far end and a near end, said far end having a first hinge part;

a second resilient arm having a far and a near end, said far end having a second hinge part, said first and second hinge parts being adapted to be releasably engaged;

a first resilient handle having a far end and a near end;

a second resilient handle having a far end and a near end;

a first rocker, having a base, adapted to join between said near end of said first arm and said near end of said first handle, defining a substantially fixed angle;

a second rocker, having a base, adapted to join between said near end of second arm and said near end of said second handle, defining a substantially fixed angle, wherein said first and second resilient handles are joined together at their far ends such that the resilient handles bow away from each other, wherein said bases of said first and second rockers are adapted to be pivotally engaged, such that upon compressing said first and second handles, said first and second resilient arms bow outwardly with respect to each other to an open position, and upon release, said resilient arms retract toward each other to a closed position.

2. The self-closing bag holder of claim 1, wherein said first and second arms comprise complementary locking means to maintain closure when said first and second resilient arms are closed.

3. The self-closing bag holder of claim 1, wherein the center of said first hinge part on said first resilient arm is aligned with said first arm, and the center of said hinge part on said second resilient arm is aligned with said second arm.

4. The self-closing bag holder of claim 1, wherein each of said first and second arms further comprises a lock thereon to prevent a bag from sliding on said arms.

5. The bag holder of claim 1, wherein said first and second resilient arms have a thickness that tapers from said near ends down towards said far ends.

6. A self-closing bag holder assembly, comprising:

a holder, comprising:

a first resilient arm having a far end and a near end, said far end forming a pair of hinge ears;

a second resilient arm having a far end and a near end, said far end forming a hinge tab, said hinge tab being adapted to be releasably engaged between said hinge ears;

a first resilient handle having a far end and a near end;

a second resilient handle having a far end and a near end, said far ends of said first and second handles being adapted to be joined together;

a first rocker, having a pivoting base, adapted to join between said near end of said first resilient arm and said near end of said first resilient handle;

a second rocker, having a pivoting base, adapted to join between said near end of second resilient arm and said near end of said second resilient handle, said pivoting bases of said first and second rockers adapted to be pivotally engaged such that first and resilient handles defining an angle greater than an angle defined by said first and second resilient arms, such that upon compressing said first and second handles, said first and second resilient arms bow outwardly with respect to each other to an open position, and upon release, said resilient arms retract toward each other to a closed position;

a flexible bag, having a rim with openings to be slid onto said first and second resilient arms of said holder.

7. The bag holder assembly of claim 6, wherein said holder is mounted on top of the rim of a container.

8. The bag holder assembly of claim 6, wherein said holder is mounted on a vertical surface.

9. A self-closing bag holder, comprising:

a first resilient member having long and short segments;

a second resilient member having long and short segments;

a first rocker joining said long and short segments of said first resilient member and forming a predetermined angle between said segments;

a second rocker joining said long and short segment of said second resilient member and forming a predetermined angle between said segments;

wherein said first and second rockers are coupled at a common pivot point;

wherein said short segments of said first and second members are coupled together and bowed outwardly away from each other, defining a handle;

wherein said long segments of said first and second members are releasably coupled together;

wherein said long segments of said first and second members are adapted to be extendable outwardly to an open position from each other upon squeezing of said handle, and retractable inwardly to a closed position upon release of said handle.

10. The bag holder of claim 9, wherein said short segments are coupled by a hinge.

11. The bag holder of claim 9, wherein said long segments of said first and second members are releasably coupled by a hinge, said hinge comprising ear and tab portion, said ear portion being integrally formed on said long segment of said first member and said tab portion being integrally formed on said long segment of said second member.

12. The bag holder of claim 9, further comprising:

locking means to releasably engage the rim of a bag to said members.

13. The bag holder of claim 9, wherein said first and second rockers are pivotally engaged with a hinge.

14. The bag holder of claim 9, further comprising a bag having a rim supported by said long segments of said first and second members.

15. A self-closing bag holder, comprising:

a first elongated resilient member having a long segment having two ends, a short segment, and a first rocker, said first rocker adapted to join said long and short segments of said first member to define a substantially fixed angle between 90 and 180 degrees;

a second elongated resilient member having a long segment having two ends, a short segment and a second rocker, said second rocker adapted to join said long and short segments of said second member to define a substantially fixed angle between 90 and 180 degrees;

means for pivotally engaging said first and second rockers;

means for joining the ends of said short segments;

wherein the joined short segments are bowed away from each other, wherein the joined long segments are bowed away from each other upon compression of said short segments by a user and wherein the joined long segments are retracted toward each other upon release of said short segments by the user.

16. The self-closing bag holder of claim 15, wherein the other ends of said long segments are joined together by a releasable hinge.

17. The self-closing bag holder of claim 15, further comprising:

means for latching said long segments together when they are closed.

18. The self-closing bag holder of claim 17, further comprising:

means for keeping the bag on said long segments from sliding.

19. The self-closing bag holder of claim 18, wherein said means for joining the ends of said short segments is a thin connector integrally formed with said short segments.

20. The self-closing bag holder of claim 19, wherein said means for pivotally engaging said first and second rockers is a thin connector integrally formed with said rockers.

21. The bag holder of claim 15, wherein said long segments of said first and second elongated resilient members have a thickness which tapers from said rockers down towards the other ends of said first and second long segments.

* * * * *